US008991983B2

(12) United States Patent
Hager et al.

(10) Patent No.: US 8,991,983 B2
(45) Date of Patent: Mar. 31, 2015

(54) PROVIDE HEAT TO END REGIONS OF A PRINTHEAD DIE

(71) Applicant: Hewlett-Packard Development Company, L.P., Houston, TX (US)

(72) Inventors: Michael Hager, Sweet Home, OR (US); Lawrence H White, Corvallis, OR (US); Alexander N Govyadinov, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/967,917

(22) Filed: Aug. 15, 2013

(65) Prior Publication Data

US 2015/0049142 A1 Feb. 19, 2015

(51) Int. Cl.

| | |
|---|---|
| ***B41J 2/05*** | (2006.01) |
| ***B41J 2/14*** | (2006.01) |
| ***B41J 2/045*** | (2006.01) |

(52) U.S. Cl.

CPC ..... *B41J 2/14112* (2013.01); *B41J 2/0453* (2013.01); *B41J 2/04533* (2013.01)

USPC ..... 347/60; 347/48

(58) Field of Classification Search

CPC ..... B41J 2/14112; B41J 2/04533; B41J 2/04561; B41J 2/14056; B41J 2/18

USPC ..... 347/17, 20, 44, 47, 56, 60–65, 67, 88, 347/92–94

See application file for complete search history.

(56) References Cited

U.S. PATENT DOCUMENTS

| | | | | |
|---|---|---|---|---|
| 5,748,214 | A * | 5/1998 | Usui et al. | 347/70 |
| 6,132,033 | A * | 10/2000 | Browning et al. | 347/63 |
| 6,527,355 | B1 | 3/2003 | Yang et al. | |
| 8,287,104 | B2 | 10/2012 | Sharan et al. | |
| 2010/0271439 | A1 | 10/2010 | Sheahan et al. | |

* cited by examiner

*Primary Examiner* — Juanita D Jackson

(74) *Attorney, Agent, or Firm* — Hewlett-Packard Patent Department

(57) ABSTRACT

A printhead die includes end regions, a nozzle surface region, fluid passages, ejection chambers, fluid ejectors, non-ejection chambers, and heating resistors. The nozzle surface region is disposed between the end regions. The fluid passages include corresponding ejection nozzles. The ejection nozzles are disposed on the nozzle surface region. The fluid ejectors correspond to the ejection chambers. Each one of the fluid ejectors selectively ejects printing fluid through a corresponding ejection nozzle. The plurality of heating resistors corresponds to the non-ejection chambers. The heating resistors selectively provide heat to the end regions while not ejecting printing fluid through the ejection nozzles.

13 Claims, 6 Drawing Sheets

PROVIDE HEAT TO END REGIONS OF A PRINTHEAD DIE

BACKGROUND

Printhead dies may include fluid ejectors corresponding to ejection chambers to selectively eject printing fluid through respective ejection nozzles of corresponding fluid passages. The ejection nozzles may be arranged on a nozzle surface region of the printhead die. A plurality of printhead dies may be used to form a printhead assembly having an extended length to increase a size of a print zone and/or print speed.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

A printhead die such as an inkjet printhead die may include an internal region and an exterior region. The internal region may include fluid ejectors, ejection chambers, and fluid passages having ejection nozzles. The ejection chambers may be in fluid communication with a printing fluid supply, for example, through a feed channel. The fluid ejectors may correspond to the ejection chambers to selectively eject the printing fluid through the respective ejection nozzles of the corresponding fluid passages. The exterior region may include end regions and a nozzle surface region disposed there between. The nozzle surface region may include the ejection nozzles arranged in columns.

Temperature variations may exist along the columns of the exterior region. For example, the end regions may become cooler than the nozzle surface region resulting in an end of die banding defect. At times, ejection chambers near ends of the printing die may produce weaker fluid drops than ejection chambers in the middle of the printing die due to thermal variations. That is, thermal variation may cause differences in nucleation and drop ejection. Consequently, drops ejected from the ejection nozzles toward the ends of the printing die may be smaller than the drops ejected from the ejection nozzles toward the middle of the printhead die. Accordingly, a printed media may exhibit a banding signature correlating to the thermal signature.

In examples, a printhead die includes end regions, a nozzle surface region, fluid passages, ejection chambers, fluid ejectors, non-ejection chambers, and heating resistors. The nozzle surface region is disposed between the end regions. The fluid passages include corresponding ejection nozzles. The ejection nozzles are disposed on the nozzle surface region. The fluid ejectors correspond to the ejection chambers. Each one of the fluid ejectors selectively ejects printing fluid through a corresponding ejection nozzle. The heating resistors correspond to the non-ejection chambers such that the heating resistors selectively provide heat to the end regions while not ejecting printing fluid through the ejection nozzles. Thus, the heating resistors provide heat to the corresponding end regions to reduce thermal variation along the ejection nozzle columns without causing printing fluid ejection. Consequently, a printed media may exhibit a reduced or non-existent banding signature.

Figure 1:
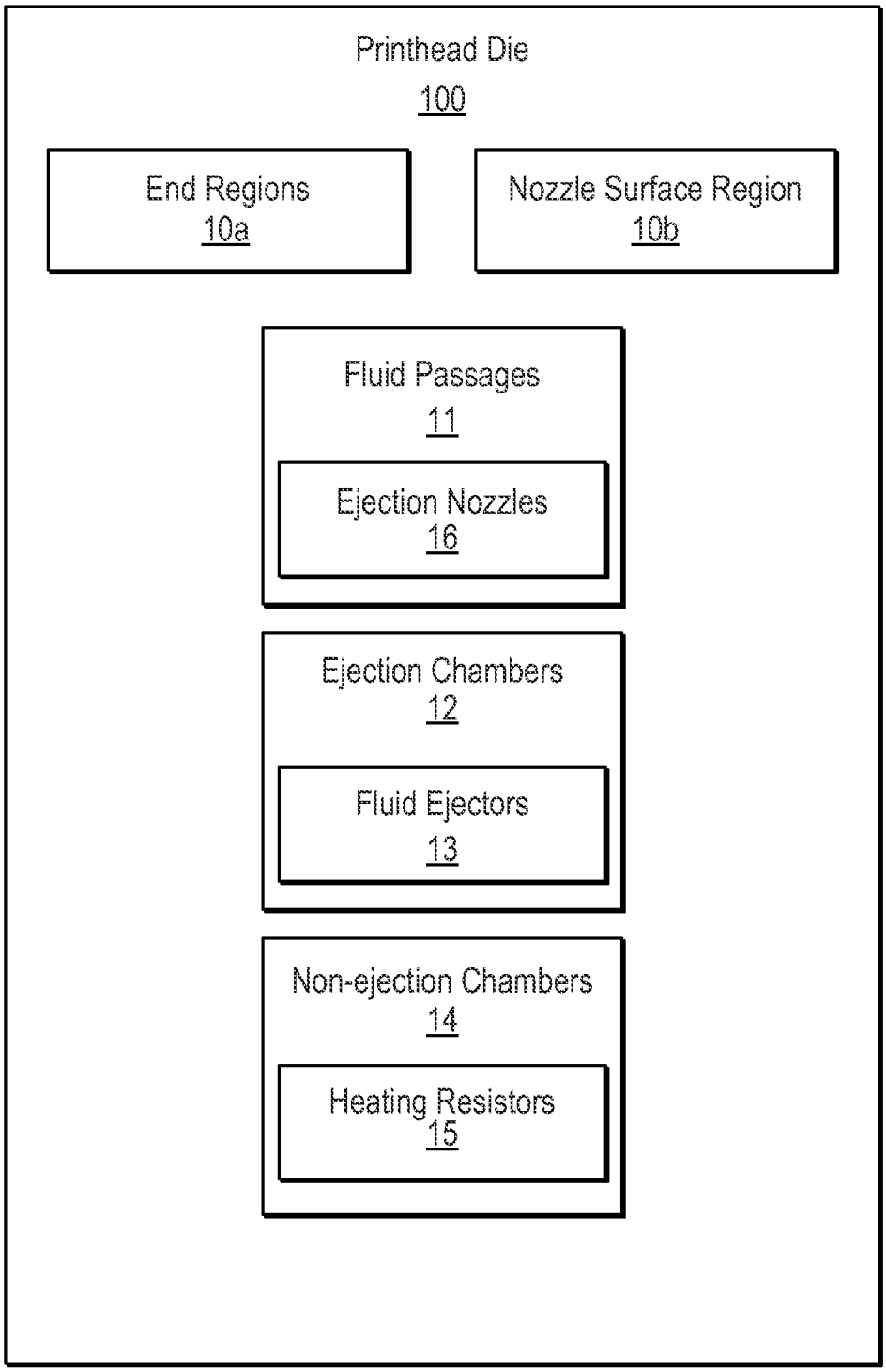
FIG. 1 is a block diagram illustrating a printhead die according to an example.

FIG. 1 is a block diagram illustrating a printhead die according to an example. Referring to FIG. 1, in some examples, a printhead die 100 includes a plurality of end regions 10*a*, a nozzle surface region 10*b*, a plurality of fluid passages 11, a plurality of ejection chambers 12, a plurality of fluid ejectors 13, a plurality of non-ejection chambers 14, and a plurality of heating resistors 15. The nozzle surface region 10*b* is disposed between the end regions 10*a*. The plurality of fluid passages 11 includes corresponding ejection nozzles 16. For example, one end of a respective fluid passage 11 may be disposed at the respective ejection chamber 12 and another end of the fluid passage 11 may be in a form of an ejection nozzle 16 at the nozzle surface region 10*b*. The ejection nozzles 16 are disposed on the nozzle surface region 10*b*. In some examples, the ejection nozzles 16 may be arranged in columns on the nozzle surface region 10*b*.

Referring to FIG. 1, in some examples, the ejection chambers 12 are in fluid communication with the corresponding fluid passages 11. The fluid ejectors 13 correspond to the ejection chambers 12. In some examples, the fluid ejectors 13 may be disposed in the ejection chambers 12. Alternatively, the fluid ejectors 13 may be proximate to the corresponding ejection chamber 12 such as below or above a surface of the ejection chamber 12. The fluid ejectors 13 may include resistors, piezoelectric members, and the like. Each one of the fluid ejectors 13 selectively ejects printing fluid through a corresponding ejection nozzle 16. For example, the printing fluid may be ejected in the form of fluid drops from the respective nozzles 16 of the corresponding fluid passages 11 associated with the respective fluid ejectors 13.

Referring to FIG. 1, in some examples, the heating resistors 15 correspond to the non-ejection chambers 14. In some examples, the heating resistors 15 may be disposed in the non-ejection chambers 14. Alternatively, the heating resistors 15 may be proximate to the corresponding non-ejection chamber 14 such as below or above a surface of the non-ejection chamber 14. The heating resistors 15 selectively provide heat to the end regions 10*a* while not ejecting printing fluid through the ejection nozzles 16. That is, each one of the heating resistors 15 is not associated with ejection nozzles 16 of fluid passages 11. Thus, activation of each one of the heating resistors 15 emits heat therefrom and does not cause printing fluid proximate thereto to be ejected through ejection nozzles 16. Heat generated from the heating resistors 15 can be transmitted to the end regions 10*a* of the printhead die 100 through portions thereof and/or by heating printing fluid. That is, the heated printing fluid may move through fluid passages 11 that are directed towards the end regions 10*a* of the printing die 100 and are not associated with an ejection nozzle 16.

Figure 2:
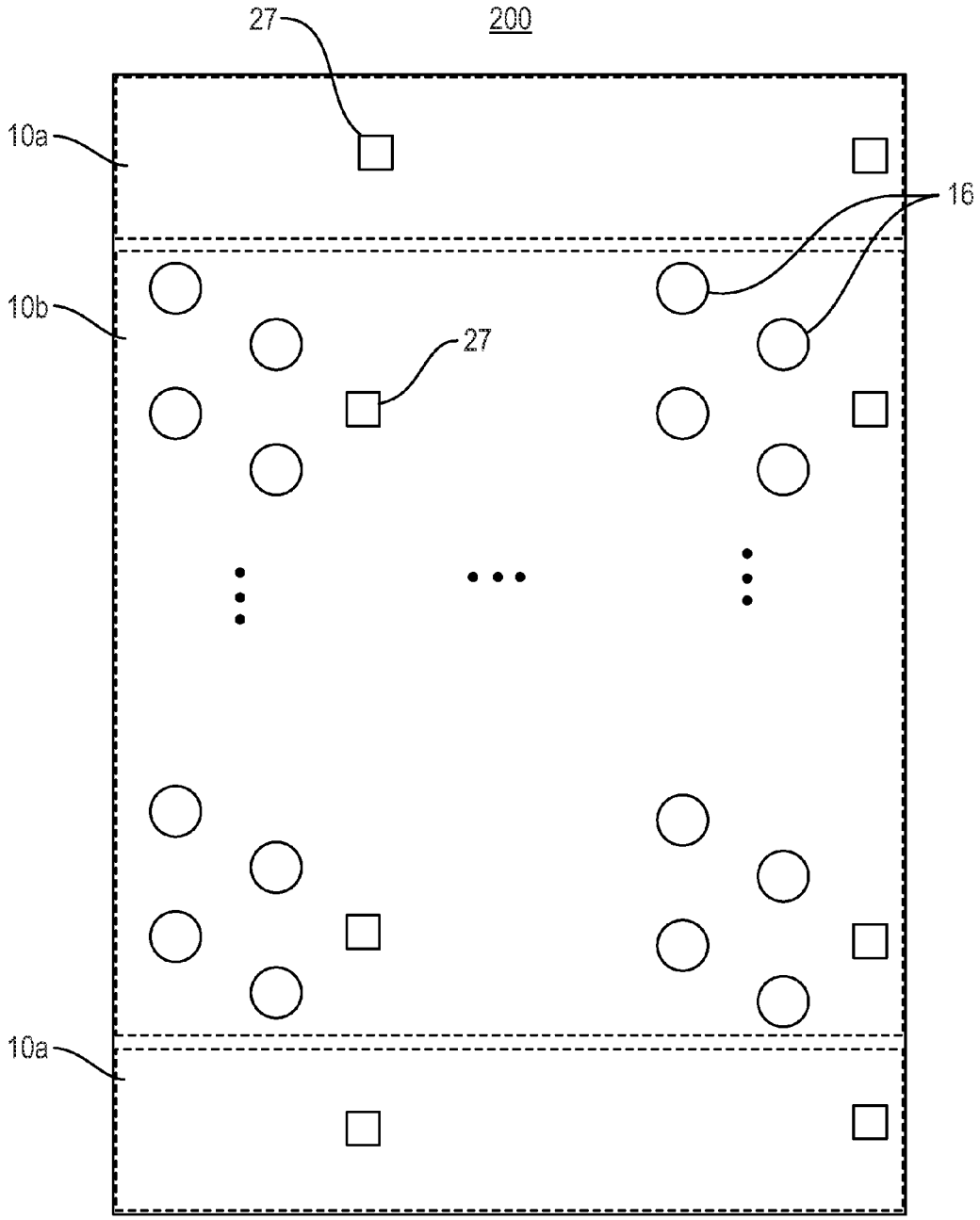
FIG. 2 is a bottom view illustrating a printhead die according to an example.
Figure 3A:
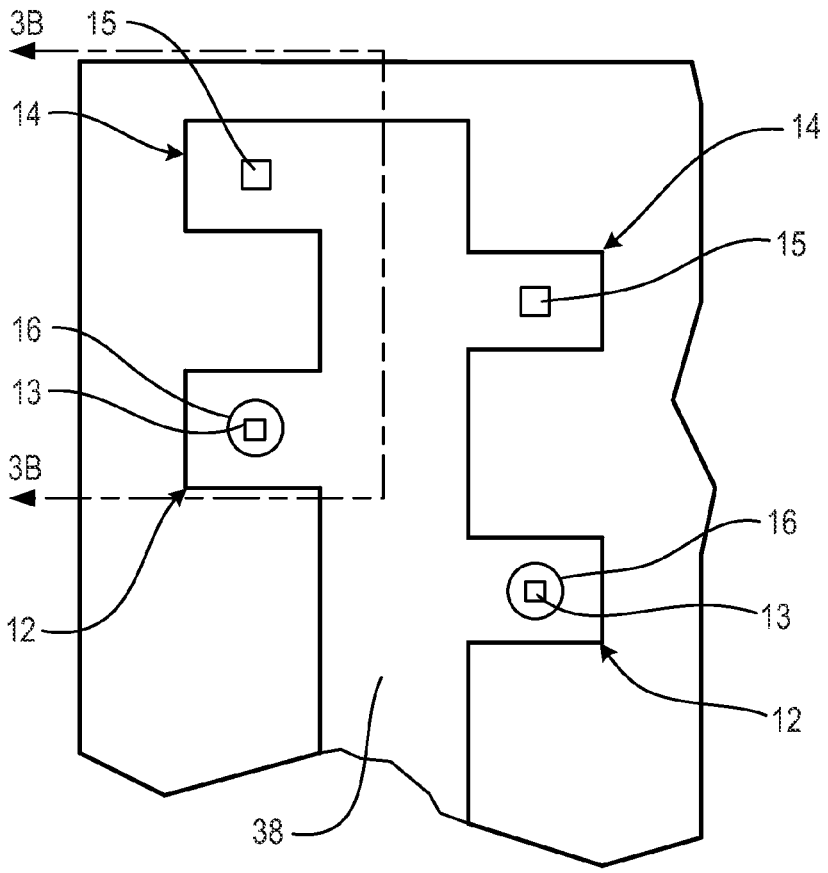
FIG. 3A is a schematic view illustrating the printhead die of FIG. 2 according to example.
Figure 3B:
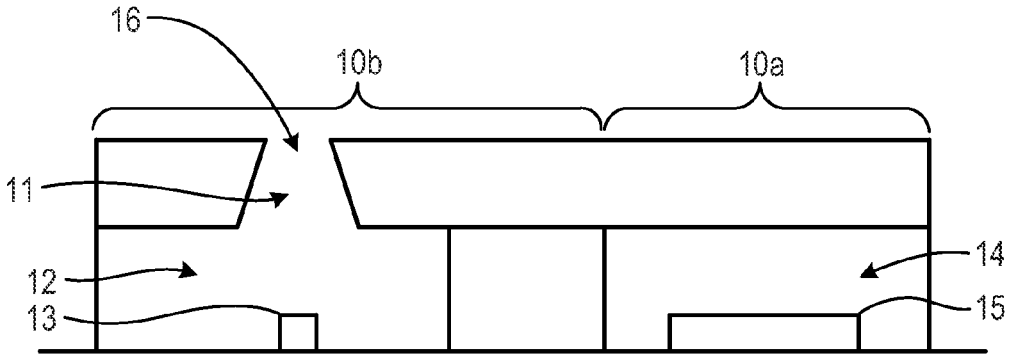
FIG. 3B is a cross-sectional view along line 3B-3B of the printhead die of FIG. 3A according to example.
Figure 4A:
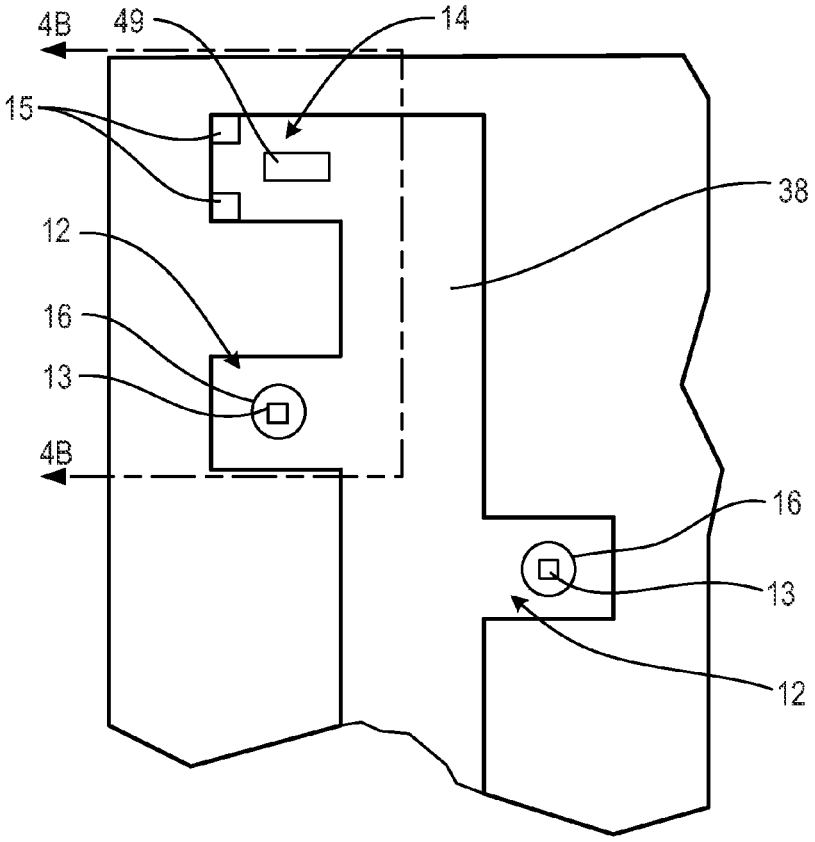
FIG. 4A is a schematic view illustrating the printhead die of FIG. 2 according to another example.
Figure 4B:
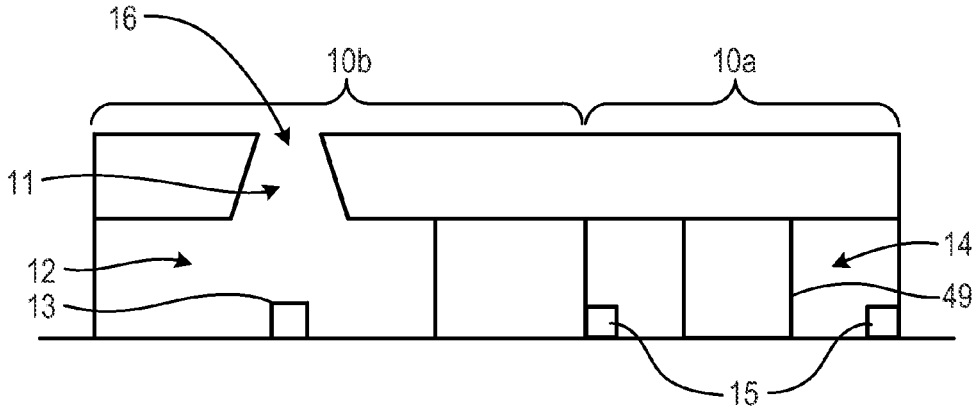
FIG. 4B is a cross-sectional view along line 4B-4B of the printhead die of FIG. 4A according to another example.

FIG. 2 is a bottom view illustrating a printhead die according to an example. FIG. 3A is a schematic view illustrating the printhead die of FIG. 2 according to example. FIG. 3B is a cross-sectional view along line 3B-3B of the printhead die of FIG. 3A according to example. FIG. 4A is a schematic view illustrating the printhead die of FIG. 2 according to another example. FIG. 4B is a cross-sectional view along line 4B-4B of the printhead die of FIG. 4A according to another example. Referring to FIGS. 2-4B, a printhead die 200 may include the plurality of end regions 10*a*, the nozzle surface region 10*b*, the plurality of fluid passages 11, the plurality of ejection chambers 12, the plurality of fluid ejectors 13, the plurality of non-ejection chambers 14, and the plurality of heating resistors 15 of the printhead of FIG. 1. The printhead die 200 is a micro-electro-mechanical system (MEMS). In some examples, the printhead die 200 may include a silicon chip and multiple layers including fluid passages 11 and ejection nozzles 16. The printhead die 200, for example, may be an inkjet printhead die such as a thermal inkjet printhead die, and the like.

Referring to FIGS. 2-4B, in some examples, the ejection chambers 12 may be in fluid communication with a printing fluid supply for example, through a feed channel 38. The fluid ejectors 13 correspond to the ejection chambers 12. In some examples, the fluid ejectors 13 may be disposed in the ejection chambers 12. Alternatively, the fluid ejectors 13 may be proximate to the corresponding ejection chamber 12 such as below or above a surface of the ejection chamber 12. In some examples, the fluid ejectors 13 may include firing resistors.

For example, an electric current may pass through a respective firing resistor resulting in rapid heating thereof. A thin layer of printing fluid proximate to the respective firing resistor may become superheated and vaporize, creating a vapor bubble in the corresponding ejection chamber 12. The rapidly expanding vapor bubble may force a fluid drop out of the corresponding nozzle 16. When the firing resistor cools, the vapor bubble may quickly collapse drawing more printing fluid into the ejection chamber 12 in preparation to eject another fluid drop from the ejection nozzle 16. Accordingly, printing fluid is ejected from the respective ejection chamber 12 through a corresponding ejection nozzle 16, and the respective ejection chamber 12 is then refilled with printing fluid, for example, from the feed channel 38 in fluid communication with the printing fluid supply.

Referring to FIGS. 2-4B, in some examples, the printhead die 200 may also include a plurality of thermal sensing resistors 27. The thermal sensing resistors 27 may be disposed along the end regions 10*a* and nozzle surface region 10*b* to detect respective temperatures thereof. In some examples, a respective heating resistor 15 is activated based on temperature differences between the respective temperatures detected by the thermal sensing resistors 27. For example, the respective temperatures may indicate that the end regions 10*a* may be cooler than the nozzle surface region 10*b* resulting in activation of respective heating resistors 15 to heat the end regions 10*a*.

Referring to FIGS. 2-4B, the heating resistors 15 may correspond to the non-ejection chambers 14. In some examples, the heating resistors 15 may be disposed in the non-ejection chambers 14. Alternatively, the heating resistors 15 may be proximate to the corresponding ejection chamber 12 such as below or above a surface of the non-ejection chamber 14. In some examples, a plurality of heating resistors 15 may correspond to each one of the non-ejection chambers 14. The non-ejection chambers 14 may be isolated from the ejection nozzles 16. The non-ejection chambers 14 may also be isolated (e.g., not in fluid communication) from a printing fluid supply. Alternatively, the non-ejection chambers 14 may be in fluid communication with the printing fluid supply. The ejection nozzles 16 may be arranged in a plurality of columns on the nozzle surface region 10*b*.

Referring to FIGS. 2-4B, in some examples, each one of the non-ejection chambers 14 may include an island member 49 disposed between the plurality of heating resistors 15 to create a fluid recirculation loop around a perimeter of the island member 49. For example, a respective non-ejection chamber 14 may include a pair of heating resistors 15 to provide heat and cause printing fluid to recirculate through the fluid recirculation loop. When in contact with printing fluid, the heating resistors 15 can deliver enough energy to create a nucleation event that results in the formation of a drive bubble. The formation of the drive bubble may displace the printing fluid causing the printing fluid to move through defined fluid passages 11 that are absent ejection nozzles 16. The fluid passages 11 may be directed towards the end regions 10*a* of the printhead die 200 or may be directed back towards a printing fluid supply region. Additionally, heating resistors 15 are sufficiently distant from other ejection nozzles 16 that the motion of the printing fluid does not cause the printing fluid to be ejected through ejection nozzles 16.

Each heating resistor 15 may have different dimensions and/or a shape than the firing resistors. For example, the size of the heating resistor 15 may be adjusted to minimize a number of the heating resistors 15 needed to tune the thermal variation along the ejection nozzle columns and corresponding non-ejection chambers 14. In some examples, the printhead die 200 may include developer ports (not illustrated) to remove wax in forming heating resistors 15 during the fabrication process and not formed to eject fluid drops therefrom.

Figure 5:
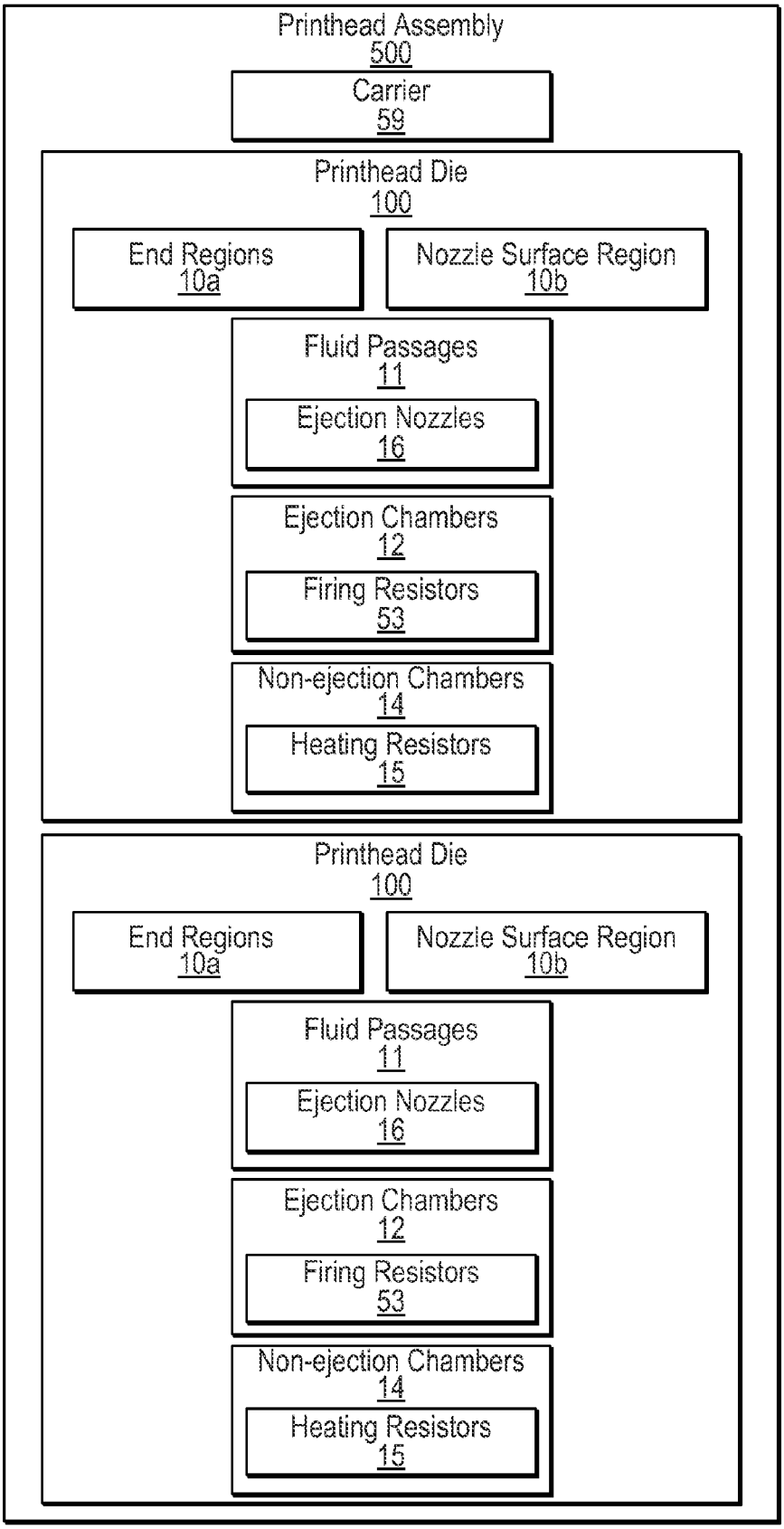
FIG. 5 is a block diagram illustrating a printhead assembly according to an example.
Figure 6:
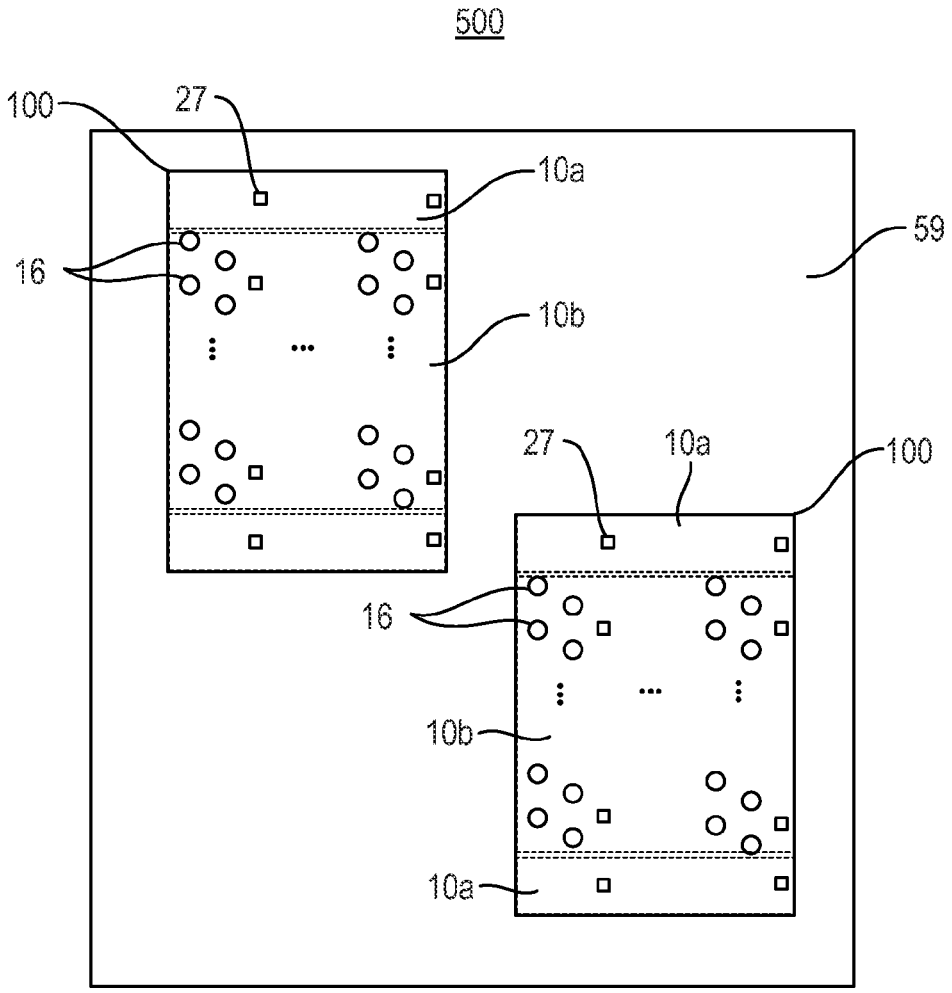
FIG. 6 is a bottom view illustrating the printhead assembly of FIG. 5 according to an example.

FIG. 5 is a block diagram illustrating a printhead assembly according to an example. FIG. 6 is a bottom view illustrating the printhead assembly of FIG. 5 according to an example. Referring to FIGS. 5 and 6, in some examples, a printhead assembly 500 includes a carrier 59 and a plurality of printhead dies 100 coupled to the carrier 59 and arranged in a printhead die array. In some examples, the printhead assembly 500 may include a page-wide, inkjet array assembly, a low-cost inkjet array assembly, and the like. For example, the printing assembly 500 may be stationary and the printing media may move through the print zone to be printed on.

Referring to FIGS. 5 and 6, in some examples, the carrier 59 may be a rigid, plastic member to receive and align printhead dies 100 with respect to each other. In some examples, the printhead die array may include two columns of printhead dies 100 staggered with respect to each other such that a portion of the respective printhead dies 100 may overlap with each other. Each one of the printhead dies 100 may include a plurality of end regions 10*a*, a nozzle surface region 10*b*, a plurality of fluid passages 11, a plurality of ejection chambers 12, a plurality of non-ejection chambers 14, and a plurality of heating resistors 15 as previously discussed with respect to FIG. 1. The printhead assembly 500 may also include firing resistors 53.

Referring to FIGS. 5 and 6, in some examples, the nozzle surface region 10*b* is disposed between the end regions 10*a*. The plurality of fluid passages 11 includes corresponding ejection nozzles 16. The ejection nozzles 16 are disposed on the nozzle surface region 10*b*. In some examples, the ejection nozzles 16 may be arranged in columns on the nozzle surface region 10*b*. In some examples, the ejection chambers 12 are in fluid communication with the corresponding fluid passages 11. The firing resistors 53 correspond to the ejection chambers 12. In some examples, the firing resistors 53 may be disposed in the non-ejection chambers 14. Alternatively, the firing resistors 53 may be proximate to the corresponding non-ejection chamber 14 such as below or above a surface of the non-ejection chamber 14. Each one of the firing resistors 53 selectively ejects printing fluid through a corresponding ejection nozzle 16. For example, the printing fluid may be ejected in the form of fluid drops from the respective nozzles 16 of the corresponding fluid passages 11 associated with the respective firing resistors 53.

Referring to FIGS. 5 and 6, in some examples, the heating resistors 15 correspond to the non-ejection chambers 14. In some examples, a plurality of heating resistors 15 may correspond to each one of the non-ejection chambers 14. In some examples, each one of the non-ejection chambers 14 may include an island member 49 disposed between the plurality of heating resistors 15 to create a fluid recirculation loop around a perimeter of the island member 49. The non-ejection chambers 14 may be isolated from the ejection nozzles 16. The heating resistors 15 selectively provide heat to the end regions 10*a* while not ejecting printing fluid through the ejection nozzles 16. That is, each one of the heating resistors 15 is not associated with ejection nozzles 16 of fluid passages 11. Thus, activation of each one of the heating resistors 15 emits heat therefrom and does not cause printing fluid proximate thereto to be ejected through ejection nozzles 16. Heat generated from the heating resistors 15 can be transmitted to the end regions 10*a* of the printhead die 100 through portions thereof and/or by heating printing fluid. That is, the heated printing fluid may move through fluid passages 11 that are directed towards the end regions 10*a* of the printing die 100 and are not associated with an ejection nozzle 16.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead die, comprising:

a plurality of end regions and a nozzle surface region disposed therebetween;

a plurality of fluid passages including corresponding ejection nozzles disposed on the nozzle surface region;

a plurality of ejection chambers in fluid communication with the corresponding fluid passages;

a plurality of fluid ejectors corresponding to respective ones of the ejection chambers, the fluid ejectors to selectively eject printing fluid through a corresponding ejection nozzle;

a plurality of non-ejection chambers;

a plurality of first heating resistors corresponding to the non-ejection chambers, the heating resistors to selectively provide heat to the end regions without ejecting printing fluid through the ejection nozzles; and a plurality of second heating resistors corresponding to respective ones of the non-ejection chambers.

2. The printhead die of claim 1, wherein the fluid ejectors comprise a plurality of firing resistors corresponding to the ejection chambers.

3. The printhead die of claim 1, wherein the non-ejection chambers includes an island disposed between the heating resistors to create a fluid recirculation loop around a perimeter of the island.

4. The printhead die of claim 1, wherein the ejection nozzles are arranged in a plurality of columns on the nozzle surface region.

5. The printhead die of claim 1, wherein the non-ejection chambers are isolated from the ejection nozzles.

6. The printhead die of claim 1, wherein the ejection chambers and the non-ejection chambers are in fluid communication with a printing fluid supply to supply printing fluid thereto.

7. A printhead die, comprising:

a plurality of end regions and a nozzle surface region disposed there between;

a plurality of fluid passages including corresponding ejection nozzles disposed on the nozzle surface region;

a plurality of ejection chambers in fluid communication with the corresponding fluid passages;

a plurality of fluid ejectors corresponding to respective ones of the ejection chambers, the fluid ejectors to selectively eject printing fluid through a corresponding ejection nozzle, the fluid ejectors comprise a plurality of firing resistors corresponding to respective ones of the ejection chambers;

a plurality of non-ejection chambers; and a plurality of heating resistors corresponding to respective ones of the non-ejection chambers, the heating resistors to selectively provide heat to the end regions without ejecting printing fluid through the ejection nozzles, the heating resistors having at least one of a different dimension or a different shape than the firing resistors.

8. A printhead die, comprising:

a plurality of end regions and a nozzle surface region disposed there between;

a plurality of fluid passages including corresponding ejection nozzles disposed on the nozzle surface region;

a plurality of ejection chambers in fluid communication with the corresponding fluid passages;

a plurality of fluid ejectors corresponding to respective ones of the ejection chambers, the fluid ejectors to selectively eject printing fluid through a corresponding ejection nozzle;

a plurality of non-ejection chambers; and a plurality of heating resistors corresponding to respective ones of the non-ejection chambers, the heating resistors to selectively provide heat to the end regions without ejecting printing fluid through the ejection nozzles, the ejection chambers are in fluid communication with a printing fluid supply to supply printing fluid thereto and the non-ejection chambers are isolated from the printing fluid supply.

9. A printhead die, comprising:

a plurality of end regions and a nozzle surface region disposed there between;

a plurality of fluid passages including corresponding ejection nozzles disposed on the nozzle surface region;

a plurality of ejection chambers in fluid communication with the corresponding fluid passages;

a plurality of fluid ejectors corresponding to respective ones of the ejection chambers, the fluid ejectors to selectively eject printing fluid through a corresponding ejection nozzle;

a plurality of non-ejection chambers;

a plurality of heating resistors corresponding to respective ones of the non-ejection chambers, the heating resistors to selectively provide heat to the end regions without ejecting printing fluid through the ejection nozzles; and a plurality of thermal sensing resistors disposed along the end regions and the nozzle surface region to detect respective temperatures thereof.

10. The printhead die of claim 9, wherein the heating resistors are activated based on temperature differences between the respective temperatures detected by the thermal sensing resistors.

11. A printhead assembly, comprising:

a carrier; and a plurality of printhead dies coupled to the carrier and arranged in a printhead die array, respective ones of the printhead dies including:

a plurality of end regions and a nozzle surface region disposed therebetween;

a plurality of fluid passages respectively including corresponding ejection nozzles disposed on the nozzle surface region;

a plurality of ejection chambers in fluid communication with respective ones of the corresponding fluid passages;

a plurality of firing resistors corresponding to respective ones of the ejection chambers, the firing resistors to selectively eject printing fluid through respective ones of the ejection nozzles;

a plurality of non-ejection chambers;

a plurality of first heating resistors corresponding to respective ones of the non-ejection chambers, the first heating resistors to selectively provide heat to the end regions while not ejecting printing fluid through the ejection nozzles; and a plurality of second heating resistors corresponding to the respective ones of the non-ejection chambers.

12. The printhead assembly of claim 11, further comprising islands disposed between respective ones of the first heating resistors to create a fluid recirculation loop around a perimeter of the corresponding island.

13. The printhead assembly of claim 11, wherein the non-ejection chambers are isolated from the ejection nozzles.

* * * * *